United States Patent [19]

Hill

[11] 3,951,123

[45] Apr. 20, 1976

[54] ENGINE DRIVEN ACCESSORY MOUNTING AND DRIVE SYSTEM FOR BUSES AND OTHER VEHICLES

[75] Inventor: Charles C. Hill, La Jolla, Calif.

[73] Assignee: Rohr Industries, Inc., Chula Vista, Calif.

[22] Filed: Nov. 27, 1974

[21] Appl. No.: 527,599

[52] U.S. Cl. ..... 123/195 A; 123/198 R

[51] Int. Cl.[2] ..... F02B 77/14

[58] Field of Search ..... 123/195 A, 195 C, 198 R

[56] References Cited

UNITED STATES PATENTS

| | | | |
|---|---|---|---|
| 2,875,746 | 3/1959 | Brice et al. | 123/195 A |
| 3,613,645 | 10/1971 | Frouuajou | 123/195 A X |
| 3,673,990 | 7/1972 | Alfieri | 123/195 A X |
| 3,730,147 | 5/1973 | Buchwald | 123/195 A X |

*Primary Examiner*—Charles J. Myhre
*Assistant Examiner*—William C. Anderson
*Attorney, Agent, or Firm*—Patrick J. Schlesinger

[57] ABSTRACT

In a bus or other vehicle propelled by an internal combustion engine, a plurality of engine accessories are mounted on bosses provided on both sides of an upright, triangular, transversely mounted accessory drive casing which is resiliently mounted on the vehicle frame at one side of the engine.

Three parallel accessory drive shafts are journaled, one within each apex of the casing, one of which, the power input shaft, is driven from the engine. The other two shafts are driven from the power input shaft. Both ends of each shaft project from the casing and the accessories are mounted on the casing in driven relation with such shaft end portions.

11 Claims, 3 Drawing Figures

10
11
12
13
14
15
18
21
22
23
24
25
27
29
30
31
32
33
34
37
38
39
47
48
49
51
52
53
57
58
59
60
61
62
63
64
67
69
70
A
B
3
3

ENGINE DRIVEN ACCESSORY MOUNTING AND DRIVE SYSTEM FOR BUSES AND OTHER VEHICLES

BACKGROUND OF THE INVENTION

It is customary at present to mount usual engine accessories which are driven by the propulsion engine of a bus or similar vehicle on mounting pads or brackets provided on the engine itself. These accessories are driven by V-belts or other power transmitting means from the crank shaft or cam shaft of the engine. Some prior attempts have been made to mount such engine accessories on a separate drive unit, for example, as shown in U.S. Pat. Nos. 3,263,663; 3,613,645 and 3,606,874. However, these prior accessory drive mechanisms are all more or less integrally and rigidly connected to the engine, so that engine vibration is transmitted to the drive unit and the accessories mounted thereon. Also, in some cases such drive units create an undesirable elongation of the engine assembly, and when the engine is removed for servicing or replacement it usually is necessary either to remove the accessory drive mechanism and accessories with the engine, or to unbolt the accessory assembly from the engine by an operation requiring a considerable amount of time.

SUMMARY OF THE INVENTION

The present invention provides a separate mechanism for the mounting and driving of a plurality of usual engine accessories of a bus or other automotive vehicle. An accessory drive unit casing is mounted alongside, and independently of, the vehicle propulsion engine, such casing being shallow and mounted upright in a plane disposed transversely of the vehicle. A plurality of accessory drive shafts are journaled in the casing with their ends projecting both forwardly and rearwardly therefrom, and mounting means are provided on the casing for mounting selected engine accessories in driven relation with projecting end portions of the shafts. The accessory drive shafts are parallel to, and in driving relation with each other, one of the shafts having driven connection with the propulsion engine of a vehicle in which the invention is embodied.

BRIEF DESCRIPTION OF THE DRAWINGS

The objectives and advantages of the invention will be apparent from the following description and the accompanying drawings, wherein.

DETAILED DESCRIPTION OF THE ILLUSTRATED FORM OF THE INVENTION

Figure 1:
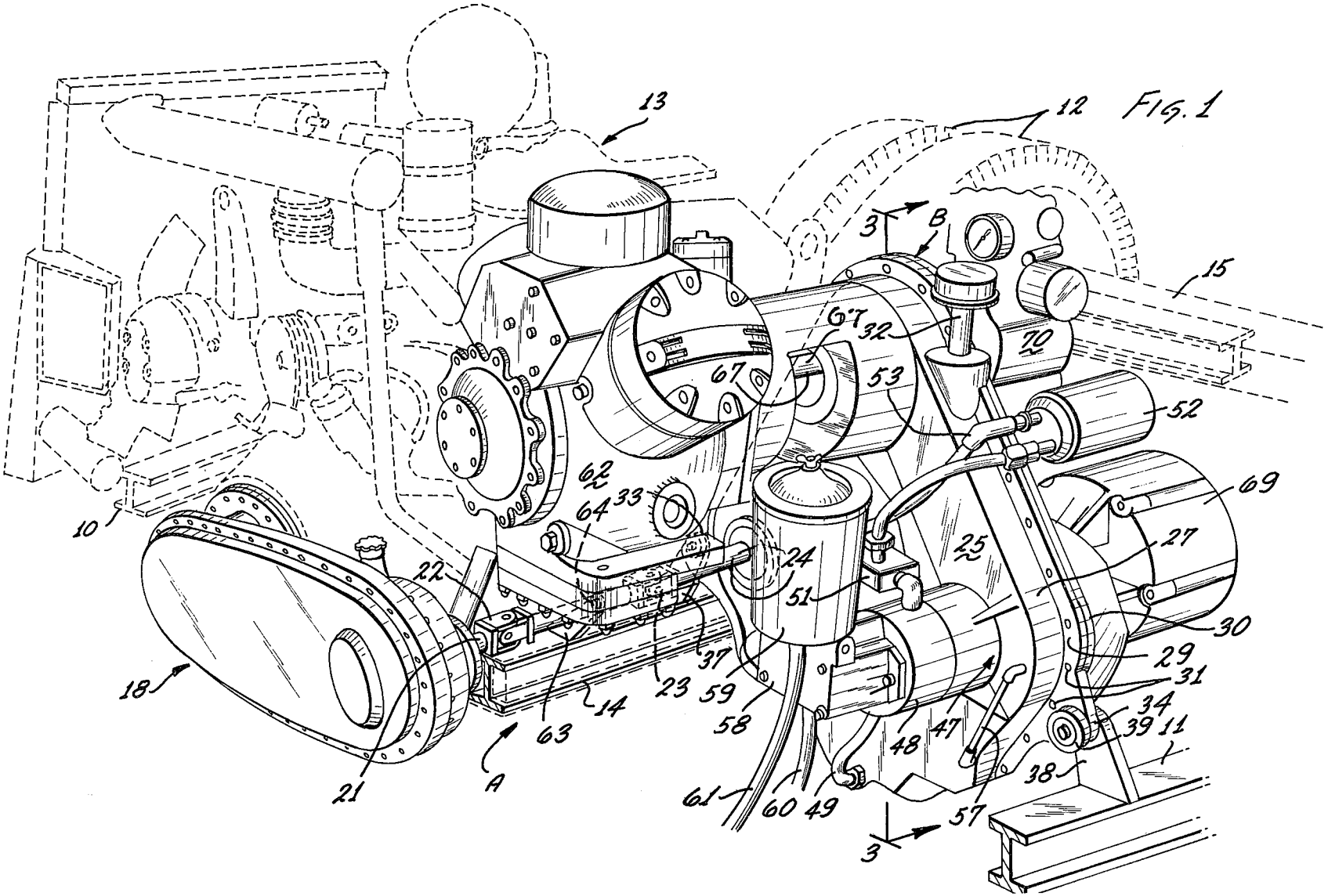
FIG. 1 is a fragmentary, perspective view looking forwardly from the right rear end of a bus chassis embodying the invention, the accessory drive mechanism with engine accessories mounted thereon and the transfer case being shown in solid lines, while the conventional parts of the chassis including the engine are shown in phantom, portions being broken away.

Referring to the drawings in detail, in a bus or other vehicle, only a portion of the chassis A of which is shown, usual side frame members 10 and 11, support and drive wheels 12, and an internal combustion propulsion engine 13, may be of suitable type. An intermediate, longitudinal, short frame member 14 also extends between a transverse bolster 15 at the forward end of the engine compartment, see FIG. 2, and a transverse rear frame member, not shown.

Figure 3:
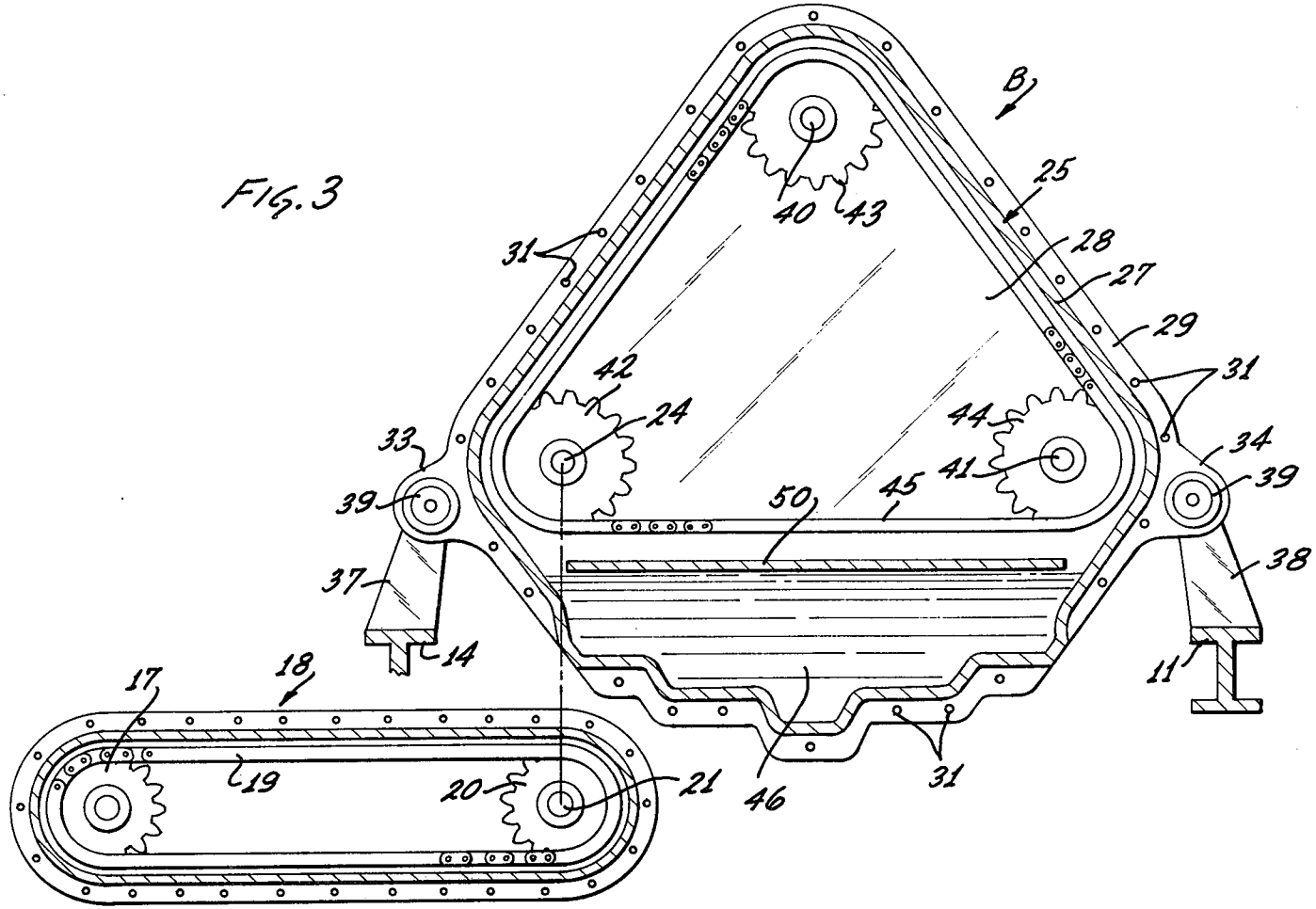
FIG. 3 is a sectional view of the casing of the accessory drive mechanism taken along the plane of line 3—3 of FIG. 1, the transfer case housing the drive chain for the mechanism being shown in similar section offset downwardly from its normal position as indicated by the vertical dot-dash line connecting the two elements of this figure.

A power take-off sprocket 17 is mounted on the crank shaft of the engine 13, see FIG. 3, and is housed in one end of a transfer case 18 bolted to the crank case of the engine. The power take-off sprocket 17 drives a chain 19, which also passes around a sprocket 20 mounted on a shaft 21 journaled in the other end of the transfer case. The driven shaft 21 is coupled by universal joints 22 and 23, see FIG. 1, to the power input shaft 24 of an accessory drive mechanism B, which mechanism is a feature of the present invention.

The power input shaft 24 is journaled within one apex of a generally triangular accessory drive casing 25, comprising two substantially symmetrical, shallow half portions 27 and 28 provided with mating flanges 29 and 30, respectively, secured together in sealed relation by cap screws 31. A combined breather and oil filter tube 32 is provided on the rear casing half portion 27. The casing 25 is mounted in upright position transversely of the chassis by means of two annular mounting bosses 33 and 34 which are provided, one on each lateral apex of the rear casing portion 27. These bosses are connected, respectively, to support standards 37 and 38, mounted on chassis frame members 14 and 11, respectively, by suitable and preferably resilient mounting means such as the well known "Lord" type mounts 39.

Journaled one within each of the other two apexes of the casing 25 than that having the power input shaft 24 journaled therein are two other shafts 40 and 41. Both ends of all three of the shafts 24, 40 and 41 project from the casing 25. A sprocket 42 is mounted on the power input shaft 24, while sprockets 43 and 44 are mounted on the other shafts 40 and 41, respectively, all within the casing 25. A drive chain 45, preferably of the inverted tooth, silent type, passes around all three sprockets 42, 43 and 44. Variation in the relative speeds of the three shafts 24, 40 and 41 can be accomplished by selectively varying the size of their respective sprockets.

Mounted on a boss 47, see FIG. 1, cast integrally with the rear casing half portion 27, and in direct driven relation with the rearwardly projecting end portion of the shaft 41, is an oil circulating pump 48, which draws oil through an intake hose 49 from a supply thereof contained in a sump comprising the lower portion of the casing 25. A baffle 50 shields the oil in the sump from the lower run of the drive chain 45 and thus prevents undue aeration of the oil.

Figure 2:
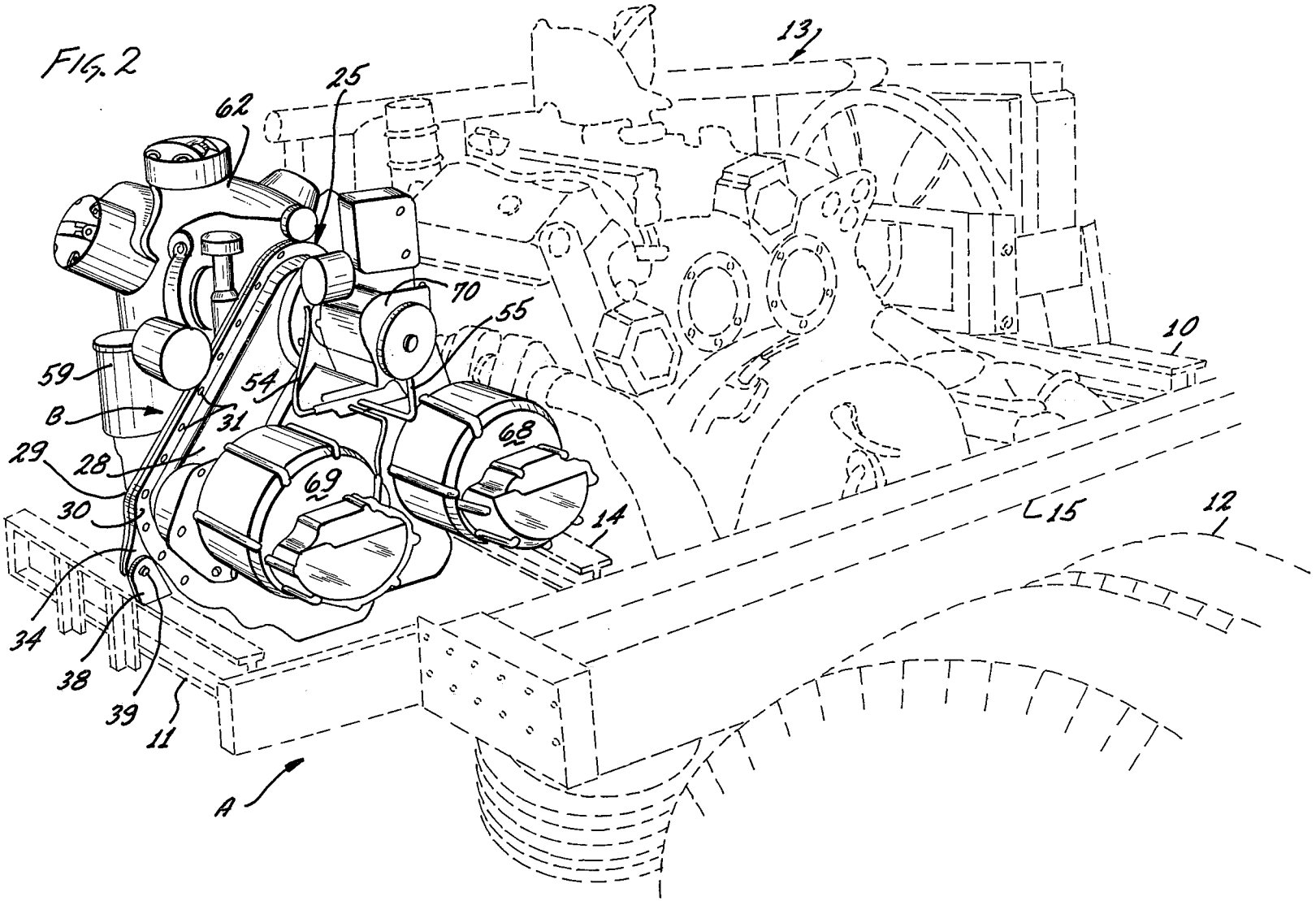
FIG. 2 is a similar type of view looking rearwardly from a point on the right side of the chassis forwardly of the engine.

Pressurized oil from the pump 48 passes through a conventional oil pressure regulator 51, oil filter 52, and thence through a hose 53 to various passages drilled in the casing half portions 27 and 28, and oil tubes such as the tubes 54 and 55, see FIG. 2, to the bearings of the accessory drive shafts 24, 40 and 41 and the various accessories mounted on the casing 25. Drain openings, not shown, return the oil to the sump. If cooling of the oil is required, the oil can be passed through a conventional oil cooler, not shown, in a well known manner. A sight glass 57 mounted on the accessory drive casing 25 shows the oil level in the sump 46.

Mounted on the end of the oil pump 48, and in driven relation with its shaft, is a conventional power steering pump 58, which draws power steering fluid from a usual reservoir 59 and supplies it through a high pressure hose 60 to the usual power steering mechanism of the vehicle in which the invention is embodied. The power steering fluid is returned to the reservoir 59 by a hose 61.

Also mounted on the casing half portion 25 is a conventional refrigerant compressor 62 for compressing freon or other suitable gas for the vehicle's air conditioning mechanism, not shown. Due to the size, weight and rearward extent of the compressor 62, a third support standard 63, see FIG. 1, is provided on the intermediate chassis frame member 14, and this standard is connected by a resilient mount 64, which may be similar to the mounts 39, to a boss provided on the underside of the compressor 62. The drive shaft 67, see FIG. 1, of the compressor 62 is coupled by suitable or well known means, not shown, to the rearward extension of the uppermost shaft 40 of the accessory drive mechanism B.

A pair of alternators 68 and 69, which supply the electrical energy required for the operation of a vehicle embodying the invention, are mounted on bosses provided therefor on the casing front half portion 28, and are in driven relation with the forwardly projecting portions of the power input shaft 24 and the other lower accessory drive shaft 41, respectively.

An air compressor 70 also is mounted on a base provided therefor on the front casing portion 28 and is in driven relation with the forwardly projecting portion of the upper accessory drive shaft 40. The air compressor 70, of suitable capacity to supply the requirements of the vehicle in which it is mounted, delivers compressed air to a usual accumulator, not shown, for delivery to the various mechanisms requiring compressed air, such as brakes and door actuators.

OPERATION OF THE ILLUSTRATIVE FORM OF THE INVENTION

Assume that the illustrative mechanism embodying the present invention is set up as illustrated, with the transfer case sprockets 17 and 20, and the accessory drive sprockets 42, 43 and 44 all properly proportioned so that when the engine 13 is operated within its normal limits the accessory drive shafts 24, 40 and 41 will be driven at speeds suitable for operation of the various accessories mounted on the accessory drive casing 25.

The accessories mounted on the resiliently supported accessory drive casing 25 are substantially free of engine vibration, and being well spaced from each other, are easily accessible for servicing or replacement as required without disturbing the engine 13. Additionally, the absence of accessories from the engine makes the latter more accessible for routine maintenance, avoids subjecting accessories to high temperatures of the engine surface and frees the engine from hot spots which may develop when accessories are mounted directly on the engine.

In removing the engine from a vehicle embodying the invention, it is necessary merely to release one of the universal joints 22 or 23 to release the engine from the accessory drive mechanism B. When replacing a removed engine with the same one or one of the same type, after setting the engine in it is necessary merely to re-couple the loosened joint to the power input shaft 24 in order to operate the accessories shown in the drawings, since these accessories remain operatively connected to the various mechanisms which they actuate or supply.

In the event that a removed engine is replaced by one of a different type, such change may require the changing of one or more of the transfer case sprockets 17 and 20, which may be readily done by removing the transfer case cover 18a. In the event that it should be necessary to change one or more of the transfer case sprockets 42, 43 and 44, the front accessory drive casing half portion 28 can be removed upon removal of the cap screws, leaving the rear casing half portion 27 supported by the three standards 37, 38 and 63, and with the plumbing and other connections to the accessories mounted on this rear casing portion intact. After making the required sprocket changes the parts are reassembled as illustrated and described herein.

While the illustrative form of the invention shows a rear-mounted engine it is obvious that the invention may as readily be embodied with a front mounted engine provided the necessary space is available.

The invention does not increase engine length, an important feature in buses and similar vehicles, since any elongation of the engine may require the sacrifice of valuable space within the body of the vehicle.

Having thus described the invention, what is claimed as new and useful and desired to be secured by U.S. Letters Patent is:

1. In a bus or similar vehicle having a vehicle frame and with the propulsion engine of the vehicle mounted to the vehicle frame with a clear space of required size alongside such engine, an engine accessory drive mechanism comprising:

an accessory drive casing mounted to the vehicle frame in such space, a plurality of shafts journaled in the casing with at least one end of each of said shafts projecting beyond the casing, an accessory mounting boss integral with the casing, adjacent each of a plurality of the projecting shaft end portions, first drive means operatively connecting one of said shafts, designated the "power input shaft", to a power driven element of the vehicle's propulsion engine for rotation thereby, and an engine accessory mounted on each of said bosses, each of said accessories having driven connection with the projecting shaft end portion adjacent which it is mounted.

2. Engine accessory drive mechanism as claimed in claim 1 wherein the casing is shallow, substantially flat, and is mounted upright transversely of said vehicle.

3. Engine accessory drive mechanism as claimed in claim 2 wherein the accessory drive casing is triangular, comprises two generally symmetrical, triangular, shallow pans, each of which is provided with a mating flange, and means securing the two mating flanges together in sealed relation with the pans in relatively inverted position.

4. Engine accessory drive mechanism as claimed in claim 3 wherein one of the accessory drive shafts is journaled within each apex of the triangular frame, gear means operatively connect each of the other shafts journaled in said frame to the power input shaft, and both ends of each of the accessory drive shafts project beyond the accessory drive casing.

5. Engine accessory drive mechanism as claimed in claim 1 wherein the first drive means comprises a transfer case enclosing a sprocket mounted on the vehicle propulsion engine and also encloses a second sprocket mounted on a shaft journaled in the transfer case and generally aligned with the power input shaft, a drive chain passes around the two sprockets, and at least one universal joint operatively connects the shaft of the second sprocket to the power input shaft.

6. Engine accessory drive mechanism as claimed in claim 5 wherein the transfer case is fixedly, removably connected to a fixed element of the vehicle propulsion engine.

7. In a bus or similar vehicle having the propulsion engine of the vehicle mounted with a clear space of required size laterally alongside such engine transversely of the vehicle:

an accessory drive mechanism mounted to a vehicle element for operation in such clear space, a plurality of accessory drive shafts journaled in such mechanism, first drive means operatively connecting one of said accessory drive shafts, designated the "power input shaft," to a power driven element of the vehicle's propulsion engine for rotation thereby, second drive means operatively connecting each of the other accessory drive shafts to the power input shaft for rotation thereby, and a plurality of engine accessories mounted on said accessory drive mechanism, each of said accessories having driven connection with one of the accessory drive shafts.

8. An accessory drive mechanism as claimed in claim 7 wherein at least two of said accessories are mounted for operation within such clear space and on opposite sides of the accessory drive mechanism in a direction lengthwise of the vehicle.

9. An accessory drive mechanism as claimed in claim 7 wherein the accessory drive mechanism is mounted in spaced relation to a frame element of the vehicle, and resilient support means are interposed in supporting relation between the accessory drive mechanism and such vehicle frame element.

10. In a bus or similar vehicle having the propulsion engine thereof mounted with a clear space of required size alongside such engine transversely of the vehicle, an accessory drive mechanism comprising:

a shallow, generally flat, accessory drive casing mounted upright in such clear space in a plane extending transversely of the vehicle, a plurality of accessory drive shafts journaled in such casing, first drive means operatively connecting one of the said accessory drive shafts, designated the "power input shaft," to a power driven element of the vehicle's propulsion engine, second drive means operatively connecting each of the other accessory drive shafts to the power input shaft, and a plurality of engine accessories mounted on said accessory drive casing, each of said accessories having driven connection with one of the accessory drive shafts for operation in such clear space.

11. Engine accessory drive mechanism as claimed in claim 10 wherein at least one end of each of a plurality of the accessory drive shafts projects beyond the accessory drive casing, and each of the accessories is operatively connected in driven relation to a projecting end portion of one of the accessory drive shafts.

* * * * *